US006907736B2

(12) United States Patent
Ohnishi et al.

(10) Patent No.: US 6,907,736 B2
(45) Date of Patent: Jun. 21, 2005

(54) GAS TURBINE COMBUSTOR HAVING AN ACOUSTIC ENERGY ABSORBING WALL

(75) Inventors: Keizo Ohnishi, Takasago (JP); Kazufumi Ikeda, Takasago (JP); Masaki Ono, Takasago (JP); Masaharu Nishimura, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/032,035

(22) Filed: Dec. 31, 2001

(65) Prior Publication Data

US 2002/0088233 A1 Jul. 11, 2002

(30) Foreign Application Priority Data

Jan. 9, 2001 (JP) ..... 2001-001837

(51) Int. Cl.[7] ..... F02C 7/24; F23R 3/06

(52) U.S. Cl. ..... 60/725; 60/752; 60/757; 60/755

(58) Field of Search ..... 60/754, 725, 752, 60/755, 756, 757; 431/114

(56) References Cited

U.S. PATENT DOCUMENTS

| | | | | | |
|---|---|---|---|---|---|
| 2,610,467 | A | * | 9/1952 | Miller | 60/800 |
| 3,433,015 | A | * | 3/1969 | Sneeden | 60/804 |
| 3,974,647 | A | * | 8/1976 | Lewis et al. | 60/725 |
| 4,199,936 | A | * | 4/1980 | Cowan et al. | 60/725 |
| 4,422,300 | A | * | 12/1983 | Dierberger et al. | 60/757 |
| 4,833,881 | A | * | 5/1989 | Vdoviak et al. | 60/725 |
| 5,279,127 | A | * | 1/1994 | Napoli | 60/754 |
| 5,417,056 | A | * | 5/1995 | Johnson et al. | 60/725 |
| 5,590,531 | A | * | 1/1997 | Desaulty et al. | 60/752 |
| 5,644,918 | A | * | 7/1997 | Gulati et al. | 60/725 |
| 5,758,504 | A | * | 6/1998 | Abreu et al. | 60/754 |
| 6,041,590 | A | * | 3/2000 | Hayton et al. | 60/766 |
| 6,351,947 | B1 | * | 3/2002 | Keller et al. | 60/725 |
| 6,530,221 | B1 | * | 3/2003 | Sattinger et al. | 60/725 |
| 6,640,544 | B2 | * | 11/2003 | Suenaga et al. | 60/725 |

FOREIGN PATENT DOCUMENTS

| | | | |
|---|---|---|---|
| EP | 0 314 261 | | 5/1987 |
| EP | 0576717 | A1 * | 3/1992 |
| EP | 0 971 172 | | 1/2000 |
| EP | 0 990 851 | | 4/2000 |
| EP | 1 213 539 | | 6/2002 |
| GB | 2 309 296 | | 7/1997 |
| GB | 2 361 302 | | 10/2001 |
| JP | 06-147485 | * | 5/1994 |
| JP | 7-293276 | * | 7/1995 |
| JP | 11-62549 | | 3/1999 |
| JP | 2001-90939 | | 4/2001 |

* cited by examiner

*Primary Examiner*—Ted Kim
(74) *Attorney, Agent, or Firm*—Oblon, Spivak, McClelland, Maier & Neustadt, P.C.

(57) ABSTRACT

A gas turbine combustor in which a part or all of the wall of the combustor disposed within an intake chamber is formed as an acoustic energy absorbing member that can absorb the acoustic energy of a combustion variation generated within the combustor. The acoustic energy absorbing member is constructed of a thin corrugated plate in a circumferential direction, a high-temperature-proof perforated material, or a back plate disposed at the outside of a perforated plate in a radial direction with a distance from the perforated plate. It is also possible to provide a covering member at the outside of the acoustic energy absorbing member in a radial direction, for covering the acoustic energy absorbing member with a distance from the acoustic energy absorbing member. It is preferable that the acoustic energy-absorbing member and/or the covering member are reinforced with a frame that extends in a circumferential direction and/or a longitudinal direction.

11 Claims, 16 Drawing Sheets

Background Art

Background Art

GAS TURBINE COMBUSTOR HAVING AN ACOUSTIC ENERGY ABSORBING WALL

BACKGROUND OF THE INVENTION

1. Field of the Invention

The present invention relates to a gas turbine combustor and, more particularly, to a structure of a gas turbine combustor.

2. Description of the Related Art

FIGS. 16A and 16B show a conventional gas turbine combustor. FIG. 16A is a diagram showing the layout of the combustor within an intake chamber. A plurality of gas turbine combustors 10 are laid out in an approximately ring-shaped intake chamber 30 that is formed with a casing 20 consisting of an external casing 21 and an internal casing 22 (only one gas turbine combustor is shown in the drawing).

Air from a compressor enters the intake chamber 30, and passes through the surrounding of the combustor 10 and enters the inside of the combustor 10 from an air inlet opening 11 at an upper portion of the combustor. The air is pre-mixed with a fuel separately introduced from a fuel nozzle 40. The mixture is combusted within the combustor 10, and the combustion gas is supplied to a turbine.

FIG. 16B is a cross-sectional diagram of an enlarged portion of (B) in FIG. 16A. A wall 100 of the combustor 10 is constructed of a first wall 200 that extends straight at the fuel nozzle 40 side, and a second wall 200' that is inclined at a turbine chamber side. The first wall 200 is a cooling wall provided with a clearance through which cooling air passes. The second wall 200' is a double wall cooled with vapor. Both walls are connected to each other via a spring clip 105.

FIGS. 17A and 17B show a state where a combustor 10 is supplied with a cover 50 to form a convection cooling path 60, based on the structure shown in FIGS. 16A and 16B respectively. The air from the compressor is guided to the convection cooling path 60 to cool the combustor 10, and is then guided to the inside of the combustor 10. A first wall 200 and a second wall 200' of the combustor 10 have the same structures as those shown in FIG. 16B respectively. The first wall 200 and the second wall 200' shown in FIG. 16B and FIG. 17B respectively are acoustically very rigid boundaries, and they hardly transmit sound waves. Therefore, the resonance magnification of a sound field within the combustor 10 becomes high, and this can easily bring about what is called a combustion oscillation phenomenon.

The combustion oscillation is a phenomenon that a frequency component of a pressure variation of a combustion gas generated due to a generation of a combustion variation relative to a natural frequency of the sound field is amplified, and the pressure variation within the combustor 10 becomes larger. As a result, the quantities of the fuel and air introduced respectively into the combustor 10 vary, which makes the combustion variation much larger.

Particularly, a high-frequency combustion oscillation corresponding to an acoustic mode generated with a cross section of the combustor 10 is strongly influenced by the acoustic characteristics of the wall 100 of the combustor 10. This combustion oscillation occurs very easily when the wall 100 of the combustor 10 is acoustically rigid.

In recent years, along a inforcement of exhaust gas emission controls and, particularly, the inforcement of the Nox restrictions, it has become necessary to increase the ratio of the quantity of air to the quantity of fuel. In other words, it has become necessary to implement lean combustion based on a large air-to-fuel ratio. When the lean combustion is implemented, a combustion variation can occur very easily. This easily brings about a variation in the pressure of the combustion gas. Therefore, it has been strongly demanded to provide a combustor that can prevent the amplification of the pressure variation of the combustion gas in the sound field, and can restrict the occurrence of the combustion oscillation.

SUMMARY OF THE INVENTION

In the light of the above problems, it is an object of the present invention to provide a gas turbine combustor capable of preventing the occurrence of combustion oscillation.

According to the present invention, there is provided a gas turbine combustor in which a part or whole of the wall of the combustor disposed within an intake chamber is formed with an acoustic energy absorbing member that can absorb the acoustic energy of a combustion variation generated within the combustor.

In the gas turbine combustor having the above structure, the acoustic energy of a combustion variation generated within the combustor is absorbed in the wall of the combustor. Therefore, it is possible to prevent an occurrence of a combustion oscillation phenomenon.

According to one aspect of the present invention, an acoustic energy-absorbing member is constructed of a corrugated thin plate in a circumferential direction. The acoustic energy of a combustion variation generated within the combustor is absorbed in the expanded thin corrugated plate in a radial direction. Further, corrugated plates divided in an axial direction may be connected together, with their end portions superimposed on each other. In this case, it becomes possible to absorb the acoustic energy of a combustion variation generated within the combustor, based on the friction between the superimposed corrugated plates as well as the expansion of the thin corrugated plates in a radial direction. Further, when the thickness and sizes of the divided corrugated plates are changed to match a plurality of frequency components of the combustion variation, it is possible to absorb the plurality of frequency components of the combustion variation. Further, when a clearance for allowing the passage of air is provided in a radial direction at each superimposed connection portion, it becomes possible to pass the cooling air through this clearance. As a result, it becomes possible to improve the cooling of the combustor.

According to another aspect of the present invention, the acoustic energy-absorbing member is a high-temperature-proof perforated material. Therefore, the acoustic energy of a combustion variation generated within the combustor can escape to the outside. As a result, it becomes possible to prevent the occurrence of a combustion oscillation phenomenon.

According to still another aspect of the present invention, the acoustic energy absorbing member is constructed of a perforated plate and a back plate disposed at the outside of the perforated plate, in a radial direction, at a distance from the perforated plate. A resonance-absorbing wall formed between the perforated plate and the back plate can absorb the acoustic energy of a combustion variation generated within the combustor.

When openings are formed on the back plate, it is possible to absorb the acoustic energy with these openings on the back plate.

Further, when a honeycomb plate is disposed between the perforated plate and the back plate to thereby partition the air in layers, it becomes possible to further improve the effect as a resonance-absorbing wall.

The diameter of holes in the perforated plate is preferably 5 mm or less.

Further, when a plurality of diameters are used for the openings on the perforated plate, it becomes possible to absorb the acoustic energy of different frequencies.

It is preferable that a distance L1 between the openings in a longitudinal direction and a distance L2 between the openings in a circumferential direction on the perforated plate respectively have a relationship of $0.25 \leqq L1/L2 \leqq 4$.

When the distances between the perforated plates are not uniform, it is possible to absorb the acoustic energy of different frequencies.

Further, when the distance between the perforated plate and the back plate is not uniform, it is possible to absorb the acoustic energy of different frequencies.

Further, when the thickness of the perforated plate is not uniform, it is possible to absorb the acoustic energy of different frequencies.

It is also possible to cool the perforated plate with vapor.

When cooling air is introduced into a gap between the perforated plate and the back plate, it becomes possible to cool the perforated plate satisfactorily.

Further, according to still another aspect of the present invention, there is disposed a covering member at the outside of the acoustic energy absorbing member in a radial direction, for covering the acoustic energy absorbing member with a distance from the acoustic energy absorbing member. It is also possible to introduce cooling air into a gap between the acoustic energy absorbing member and the covering member.

Further, according to still another aspect of the present invention, the acoustic energy absorbing member and/or the covering member are reinforced with a frame that extends in a circumferential direction and/or a longitudinal direction.

The present invention will be more fully understood from the description of the preferred embodiments of the invention set forth below, together with the accompanying drawings.

DESCRIPTION OF THE PREFERRED EMBODIMENTS

Embodiments of the present invention will be explained below with reference to the attached drawings.

Figure 1A:
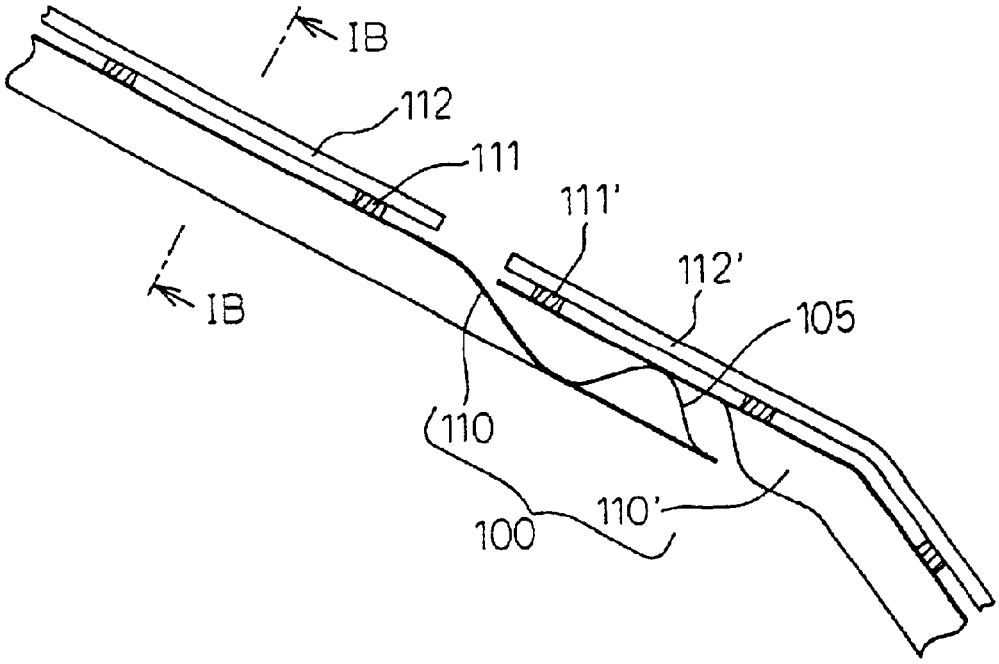
FIG. 1A is a cross-sectional diagram showing a structure of a first embodiment cut along a plane parallel with an axis.
Figure 1B:
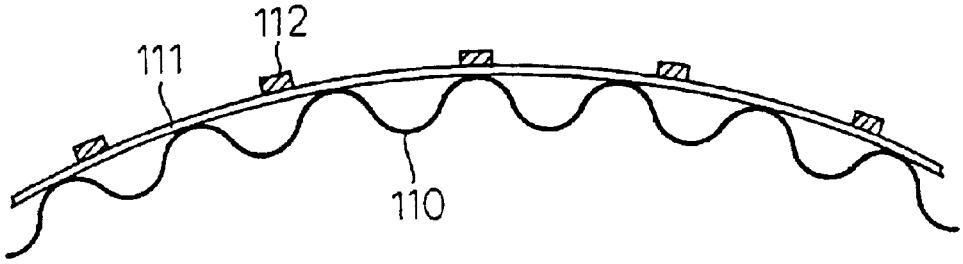
FIG. 1B is a cross-sectional diagram cut along the IB—IB line of FIG. 1A.

A first embodiment will be explained first. FIG. 1A and FIG. 1B are diagrams showing a structure of a wall 100 of a combustor 10 according to a first embodiment. A first wall 110 and a second wall 110' that constitute the wall 100 of the combustor 10 in the first embodiment are constructed of thin corrugated plates having a corrugation in a circumferential direction. The first wall 110 and the second wall 110' are connected to each other with a spring clip 105 in mutually simple cylindrical shapes instead of corrugated shapes.

Both the first wall 110 and the second wall 110' have small thickness, and therefore, they are reinforced with frames 111 and 111' in a circumferential direction, respectively. Depending on need, these walls are also reinforced with frames 112 and 112' in an axial direction, respectively.

Both the first wall 110 and the second wall 110' of the wall 100 of the combustor 10 in the first embodiment are constructed of thin corrugated plates, and they can be expanded in a radial direction according to a change in pressure. Therefore, when a sound field has been induced in a cross-sectional direction, the first wall 110 and the second wall 110' are expanded in a radial direction according to the mode. This exhibits a sound absorption effect, and the amount of sound within the combustor 10 becomes smaller. Consequently, the resonance magnification becomes smaller, and combustion oscillation does not occur easily. Further, as the first wall 110 and the second wall 110' have a small thickness, they can be sufficiently cooled with air that flows from the outside.

Figure 2A:
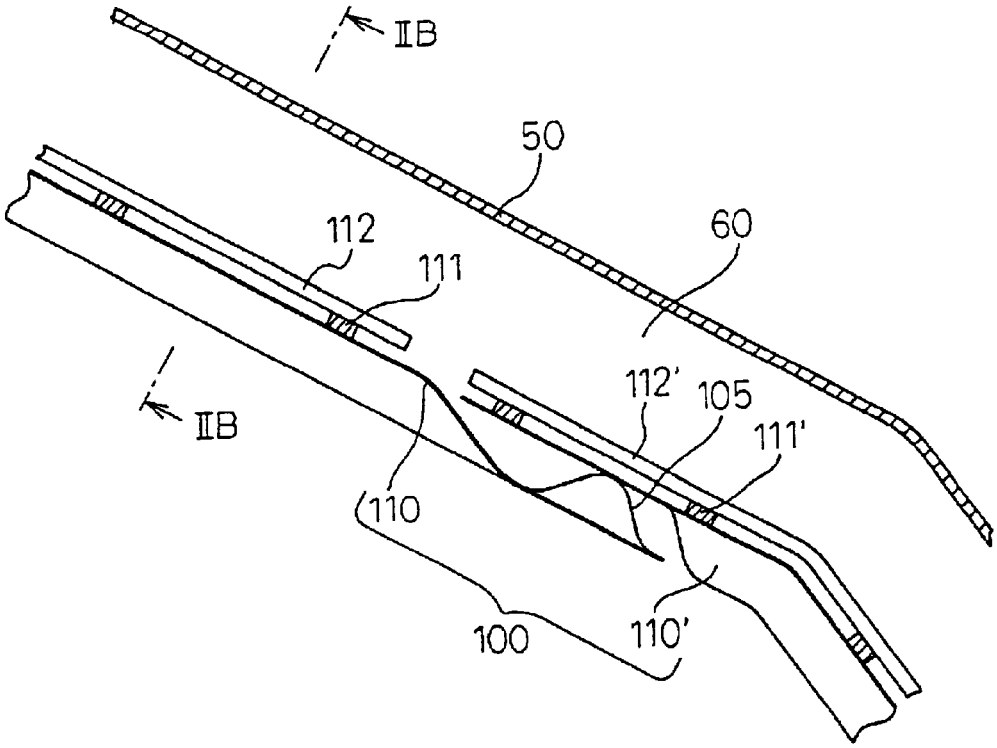
FIG. 2A is a cross-sectional diagram showing a structure of a first modification of the first embodiment cut along a plane parallel with an axis.
Figure 2B:
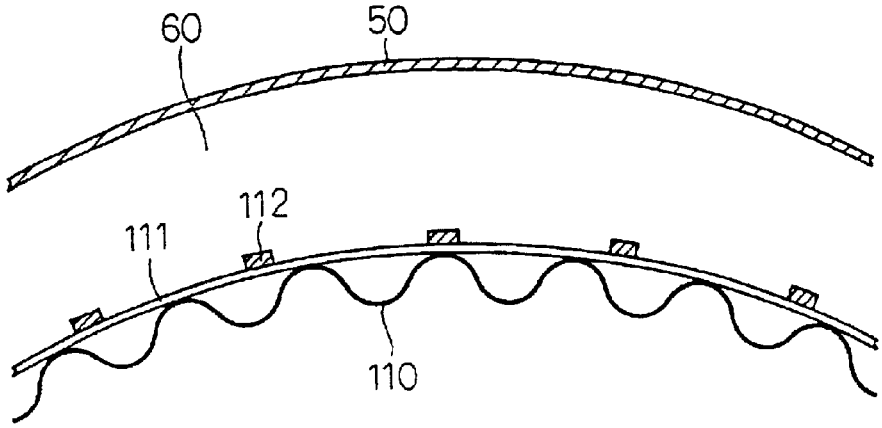
FIG. 2B is a cross-sectional diagram cut along the IIB—IIB line of FIG. 2A.

FIGS. 2A and 2B are diagrams showing a structure of a first modification of the first embodiment. The first modification shows an example of walls of a gas turbine combustor applied with a convection-cooling path 60 in a similar manner to that explained with reference to FIGS. 17A and 17B for the conventional technique.

Figure 3A:
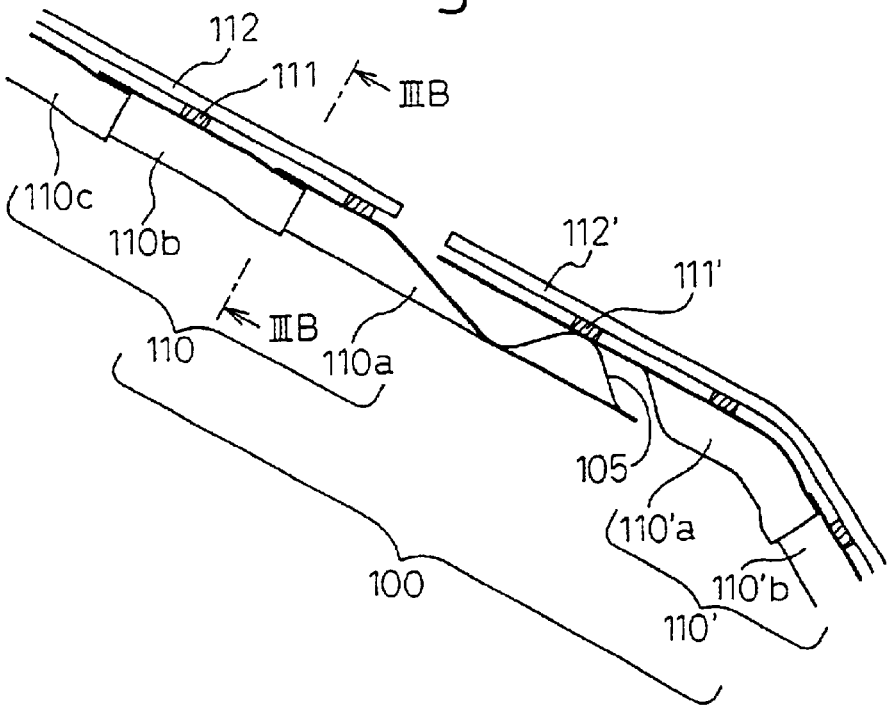
FIG. 3A is a cross-sectional diagram showing a structure of a second modification of the first embodiment cut along a plane parallel with an axis.
Figure 3B:
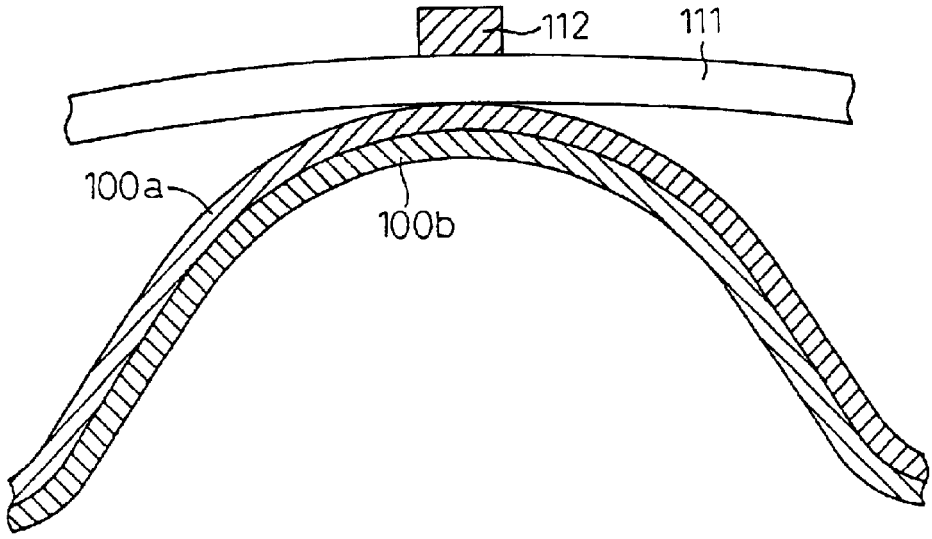
FIG. 3B is a cross-sectional diagram cut along the IIIB—IIIB line of FIG. 3A.

FIGS. 3A and 3B are diagrams showing a second modification of the first embodiment. This modification is different from the first embodiment in that a first wall 110 and a second wall 110' are divided into a plurality of walls 110*a*, 110*b*, 110*c*, etc. and 110'*a*, 110'*b*, etc. in an axial direction respectively, and these divided walls are connected together with end portions of the divided walls superimposed on each other. FIG. 3B is an enlarged diagram for facilitating understanding.

Based on the above structure, oscillation occurs easily at the superimposed portions, and there is an effect that it is possible to attenuate the oscillation with the friction generated at the mutually superimposed portions.

Figure 4:
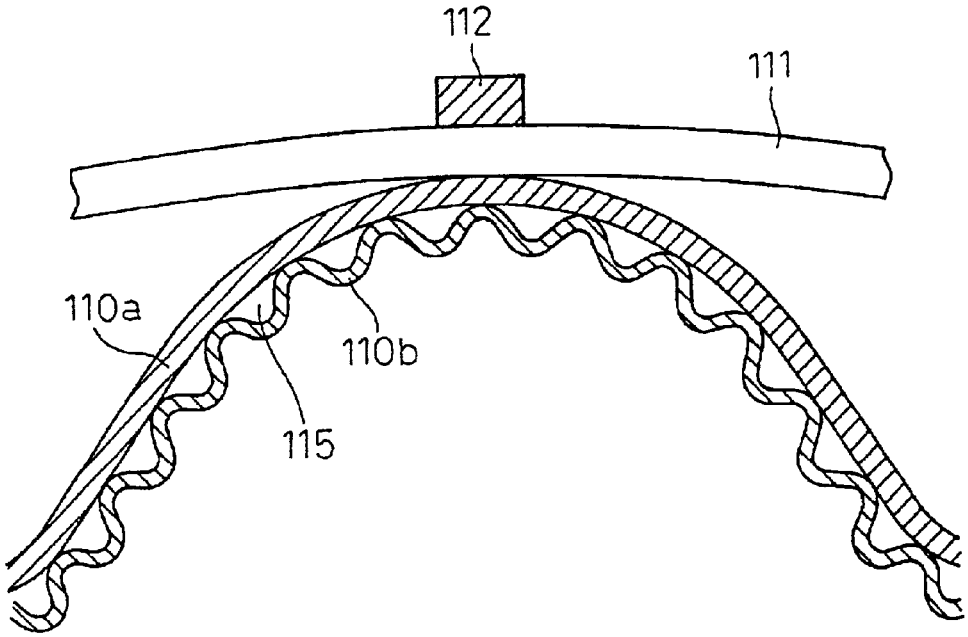
FIG. 4 is a cross-sectional diagram showing a structure of a third modification of the first embodiment.

FIG. 4 is a diagram showing a characteristic portion of a third modification of the first embodiment. This third modification is effective as a measure against a shortage in the cooling of the combustor 10. As compared with the second modification, a fine corrugated shape is formed on one side of the superimposed portion, that is, on an inside wall 110*b* in this example, as shown in the drawing. Cooling air is introduced into the combustor 10 via a clearance 115 formed as a result of this corrugation.

A method of forming the clearance 115 is not limited to this, and it is also possible to form the clearance by other method, such as, by providing a groove with a cut on one side, or by sandwiching a discontinuous spacer in a circumferential direction, for example.

Further, when the wall has a convection cooling path as explained in the second modification, it is also possible to connect the walls by superimposition, and further forming an air passage at the connection portions, as in the third and fourth modifications.

Further, when the sizes and thickness of the divided corrugated plates are changed to match a plurality of frequency components of combustion variation, it is also possible to absorb a plurality of frequency components of the combustion variation.

Figure 5A:
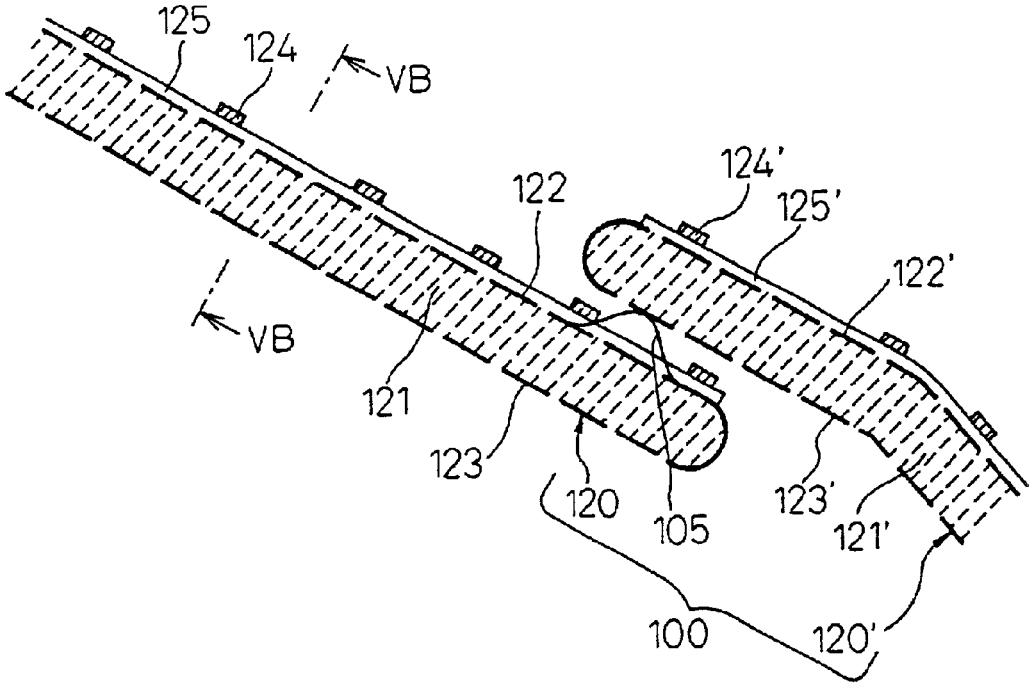
FIG. 5A is a cross-sectional diagram showing a structure of a second embodiment cut along a plane parallel with an axis.
Figure 5B:
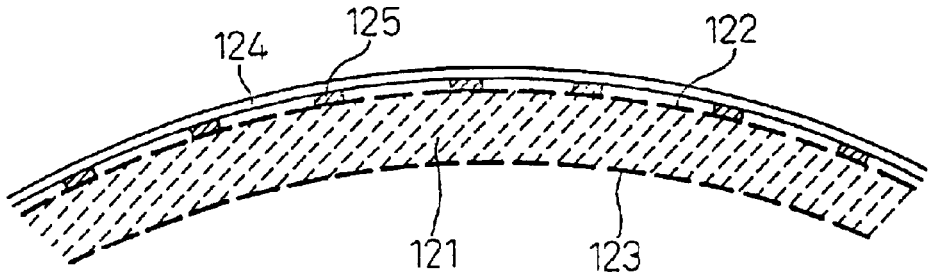
FIG. 5B is a cross-sectional diagram cut along the VB—VB line of FIG. 5A.

A second embodiment will be explained next. FIGS. 5A and 5 are diagrams showing a second embodiment. In the second embodiment, a first wall 120 and a second wall 120' constitute a wall 100 of the combustor 10. The first and second walls are formed by sandwiching perforated materials 121 and 121' such as ceramic having heat-resistance and a very large flow resistance, between perforated plates 122 and 123, and 122' and 123' from the outside in a radial direction and the inside in a radial direction respectively. The external perforated plates 122 and 122' are further supported with frames 124 and 124' in a circumferential direction and frames 125 and 125' in an axial direction respectively, for the purpose of reinforcement.

Based on the above structure of the second embodiment, acoustic energy can easily escape to the outside, and the amount of sound within the combustor 10 becomes smaller. As the resonance magnification becomes smaller, combustion oscillation does not occur easily.

Figure 6A:
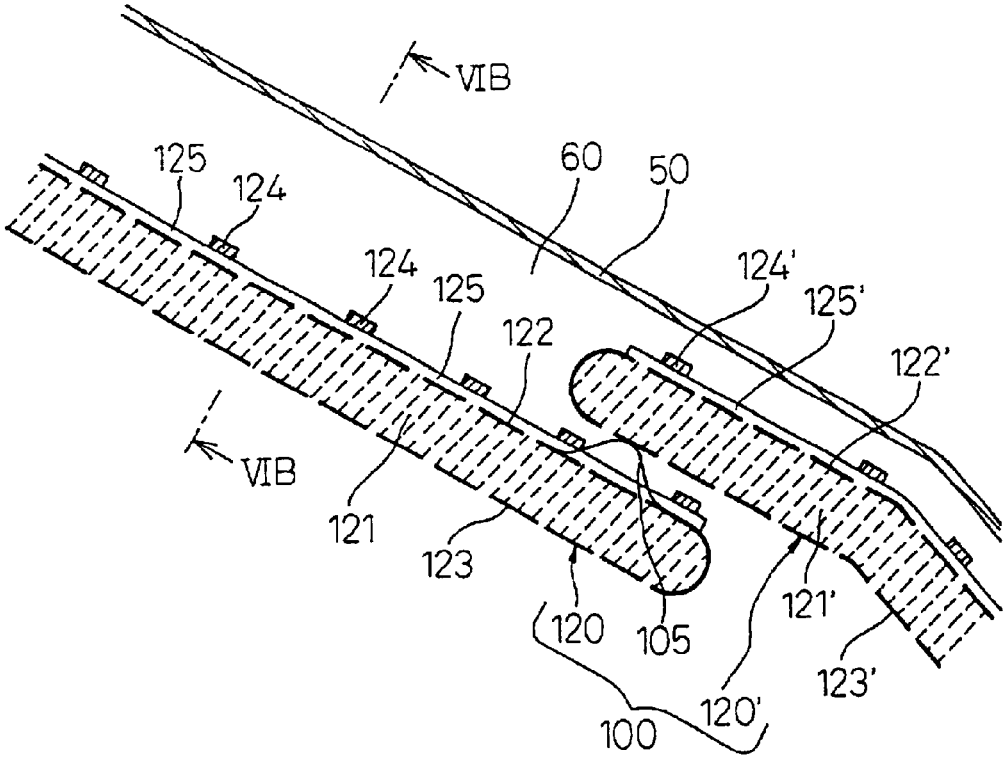
FIG. 6A is a cross-sectional diagram showing a structure of a modification of the second embodiment cut along a plane parallel with an axis.
Figure 6B:
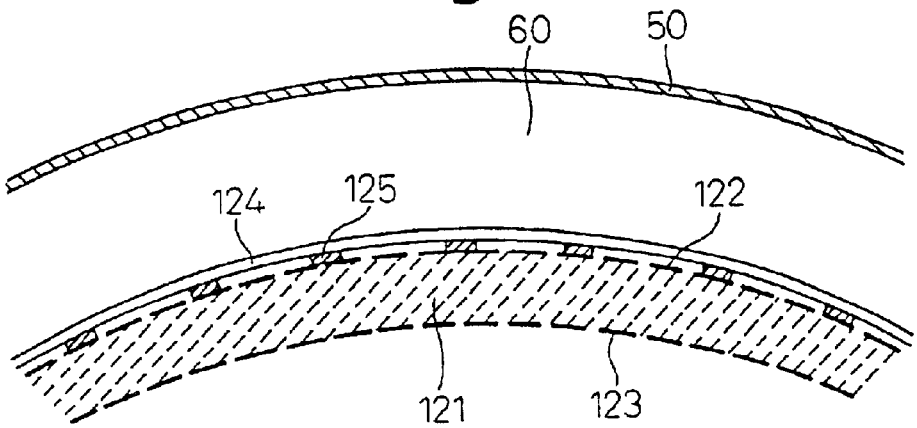
FIG. 6B is a cross-sectional diagram cut along the VIB—VIB line of FIG. 6A.

FIGS. 6A and 6B are diagrams showing a modification of the second embodiment. This modification is different from the second embodiment in that a convection-cooling path 60 is provided at the outside. With this arrangement, a reinforcement wall exists at the outside of perforated plates 121 and 121' via a back air layer, when viewed from the inside of the combustor 10. This forms a sound-absorbing wall tuned by the thickness of the back air layer. Therefore, the amount of sound inside the combustor 10 becomes smaller, and combustion oscillation does not occur easily.

Figure 7A:
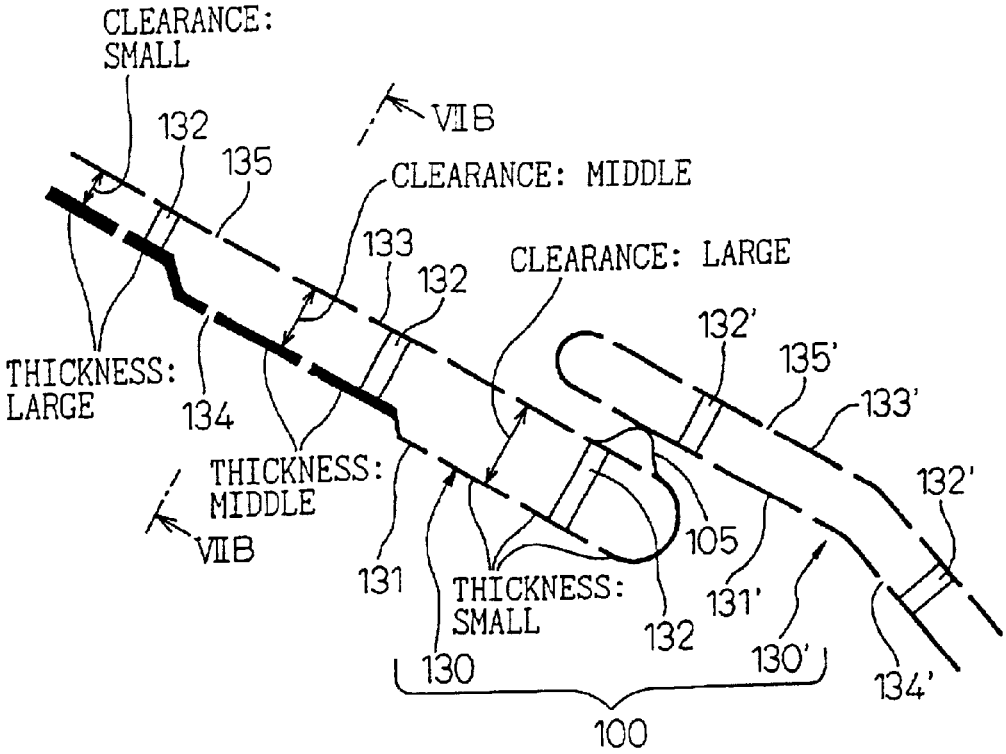
FIG. 7A is a cross-sectional diagram showing a structure of a third embodiment cut along a plane parallel with an axis.
Figure 7B:
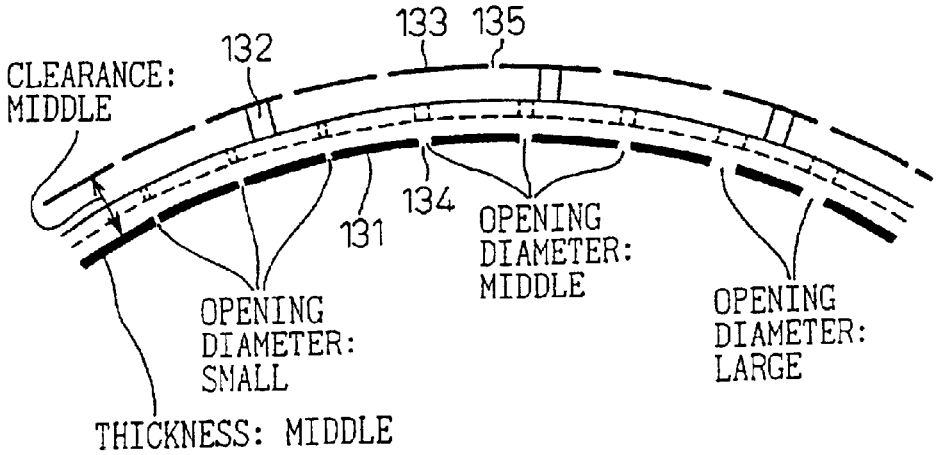
FIG. 7B is a cross-sectional diagram cut along the VIIB—VIIB line of FIG. 7A.

A third embodiment will be explained next. FIGS. 7A and 7B are diagrams showing a third embodiment. A first wall 130 and a second wall 130' constitute a wall 100 of the combustor 10. The first wall 130 and the second wall 130' are constructed of perforated plates 131 and 131' that are inside, in a radial direction, and back plates 133 and 133' disposed at the outside, in a radial direction, with a clearance from the perforated plates 131 and 131' via spacers 132 and 132' respectively. The perforated plates 131 and 131' and the back plates 133 and 133' are formed with openings 134 and 134' and openings 135 and 135' respectively.

Based on the above structure of the third embodiment, what is called a resonance-absorbing wall is formed between the perforated plate 131 and the back plate 133. The perforated plate becomes a resistor against sound pressure, and this reduces sound pressure energy. This resonance absorbing wall is different from a general resonance absorbing wall in that air is introduced into the resonance absorbing wall from the openings 135 and 135' of the back plates 133 and 133', and this air is guided to the inside of the combustor after cooling the resonance absorbing wall.

In order to attenuate a plurality of acoustic eigen values of the combustor 10, a clearance distance between the perforated plate 131 and the back plate 133 for the first wall 130 is set to be not uniform corresponding to these acoustic eigen values. Further, the thickness of the perforated plate 131 is set to be not uniform, and the diameter of the perforated plate 131 is set to be not uniform also. The diameters of the openings on the back plate 133 are set to be uniform.

In this example, the thickness of the perforated plate 131 and the distance of the clearance are changed in an axial direction, and the diameters of the openings 134 are changed in a circumferential direction. However, these parameters can be changed in any direction.

Figure 8A:
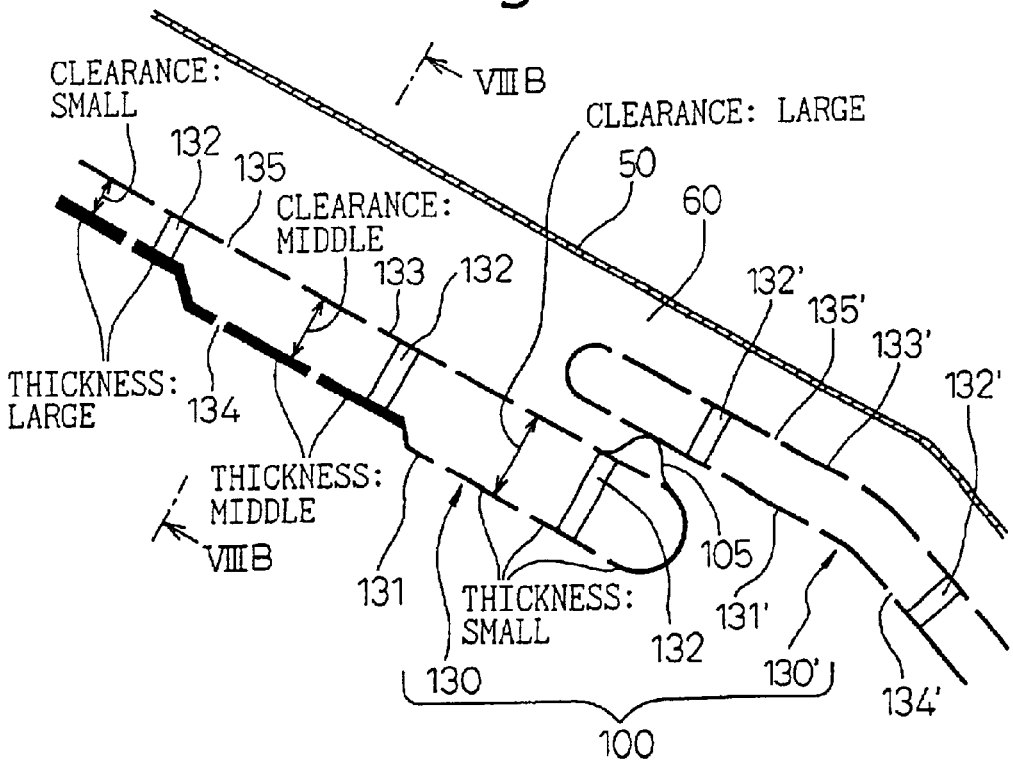
FIG. 8A is a cross-sectional diagram showing a structure of a first modification of the third embodiment cut along a plane parallel with an axis.
Figure 8B:
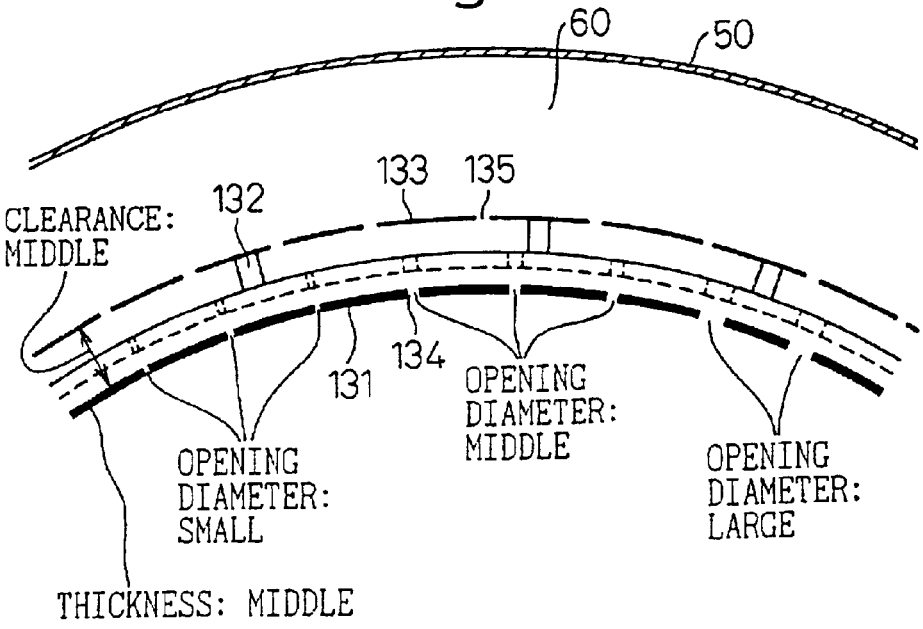
FIG. 8B is a cross-sectional diagram cut along the VIIIB—VIIIB line of FIG. 8A.

FIGS. 8A and 8B are diagrams showing a structure of a first modification of the third embodiment. This first modification is different from the third embodiment in that a convection-cooling path 60 is provided at the outside. With this arrangement, as in the first modification of the first embodiment, a reinforcement wall exists at the outside of a sound absorbing wall that is formed with perforated plates 131 and 131' and back plates 133 and 133', when viewed from the inside of the combustor 10. This forms a sound-absorbing wall tuned by the thickness of the back air layer. Therefore, the amount of sound inside the combustor 10 becomes smaller, and combustion oscillation does not occur easily.

Figure 9A:
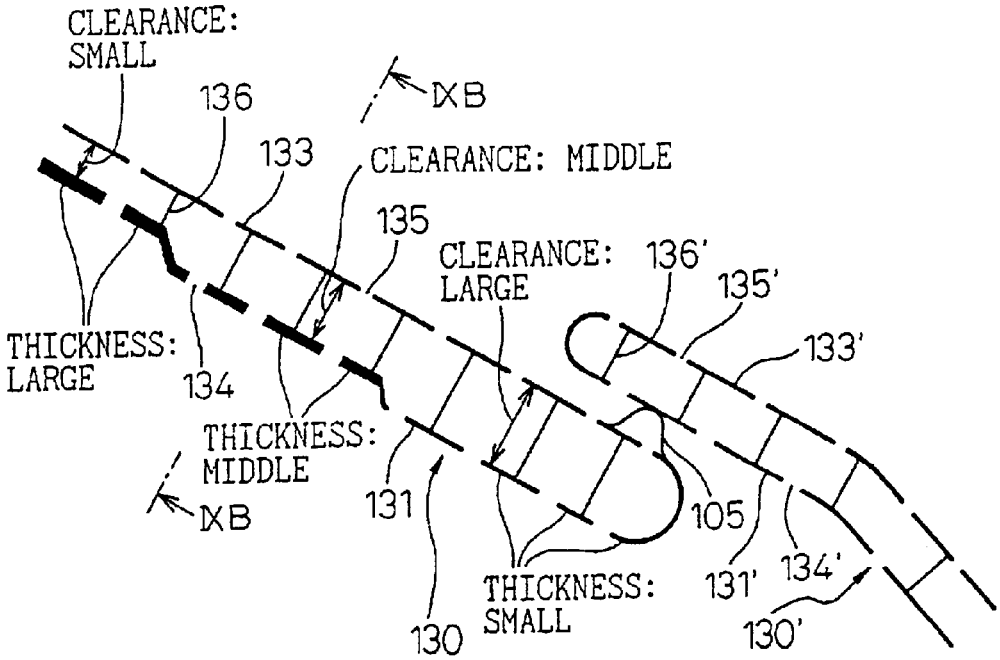
FIG. 9A is a cross-sectional diagram showing a structure of a second modification of the third embodiment cut along a plane parallel with an axis.
Figure 9B:
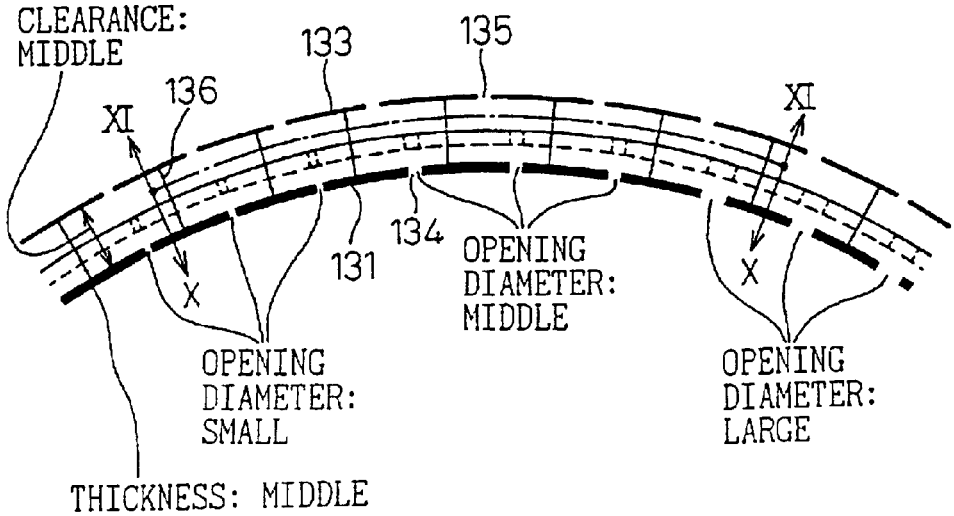
FIG. 9B is a cross-sectional diagram cut along the IXB—IXB line of FIG. 9A.
Figure 10:
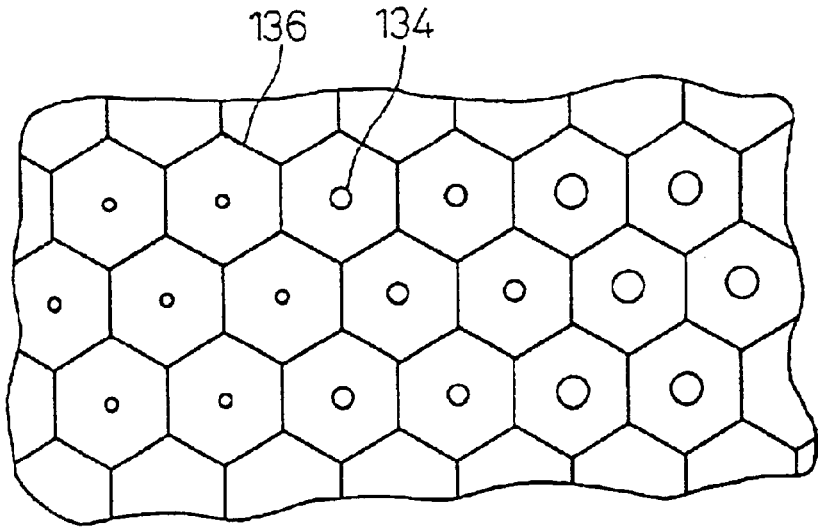
FIG. 10 is a cross-sectional diagram cut along the X—X line of FIG. 9B.
Figure 11:
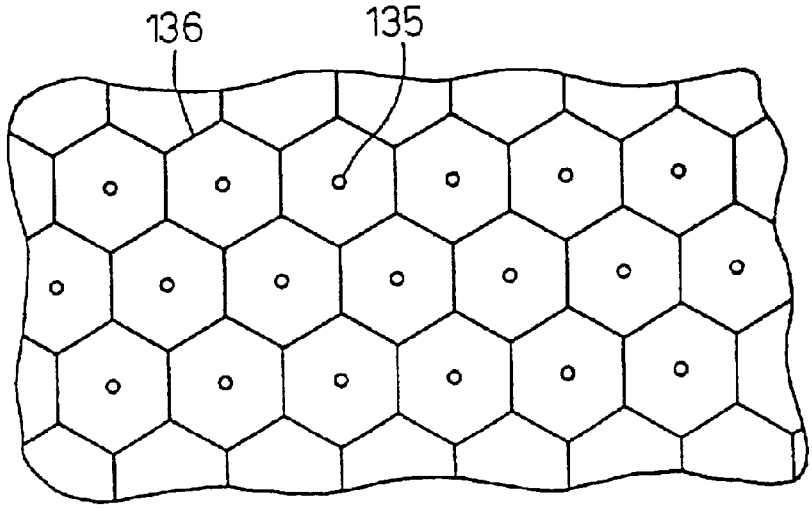
FIG. 11 is a cross-sectional diagram cut along the XI—XI line of FIG. 9B.

FIGS. 9A and 9B are diagrams showing a structure of a second modification of the third embodiment. FIG. 10 is a cross-sectional diagram cut along the X—X line of FIG. 9B, and FIG. 11 is a cross-sectional diagram cut along the XI—XI line of FIG. 9B. The second modification of the third embodiment is different from the third embodiment in that honeycomb materials 136 and 136' are disposed in place of the spacers 132 and 132' respectively.

Based on the above structure of the second modification of the third embodiment, it is possible to exhibit an effect similar to that of the third embodiment.

It is also possible to provide a convection-cooling layer 60 in the second modification, as in the first modification.

Figure 12:
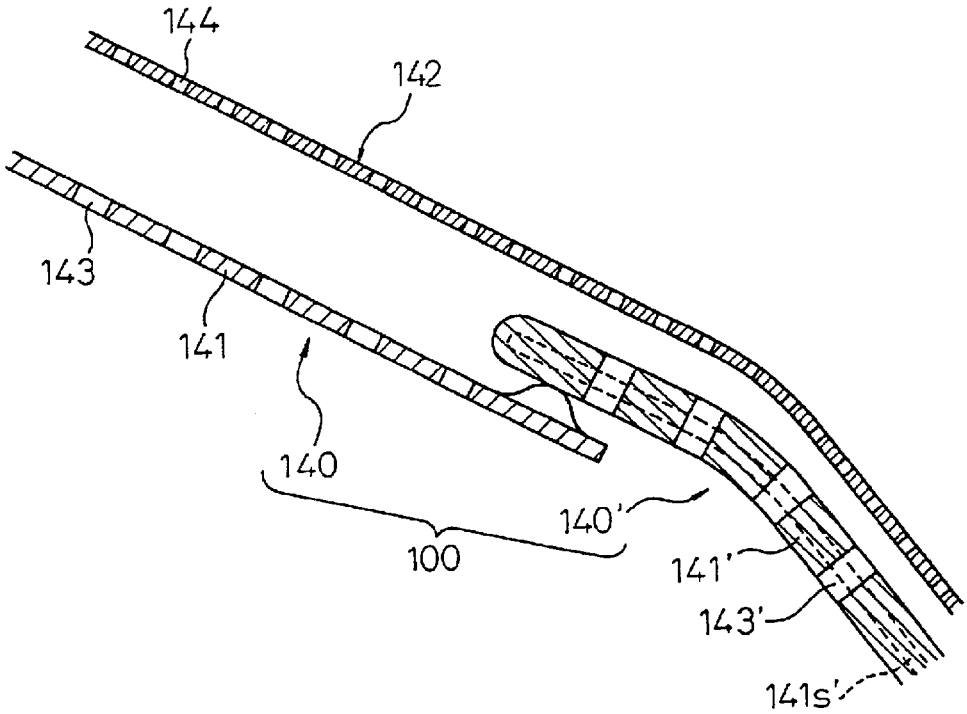
FIG. 12 is a cross-sectional diagram showing a structure of a third modification of the third embodiment cut along a plane parallel with an axis.

A third modification of the third embodiment will be explained next. FIG. 12 is a cross-sectional diagram showing a structure of a third modification of the third embodiment. A first wall 140 and a second wall 140' constitute a wall 100 of the combustor 10. The first wall 140 and the second wall 140' are constructed of perforated plates 141 and 141' that are inside, in a radial direction, and a common back plate 142 disposed at the outside, in a radial direction, with a clearance from the perforated plates 141 and 141'. The perforated plates 141 and 141' are formed with openings 143 and 143', and the back plate 144 is formed with openings 144, as in the third embodiment and the first and second modifications.

However, the back plate 142 is disposed at a position similar to that of the cover 50 that forms the convection cooling path 60 in the modification of the first embodiment, the first modification of the second embodiment, and the first modification of the third embodiment, respectively. This back plate 142 is different from the covers 50 in the third embodiment and the first and second modifications in that the distances of the clearance between the back plate 142 and the perforated plates 141 and 141' respectively are large.

Therefore, it is not necessary to provide the cover 50 in the third modification of the third embodiment.

It is preferable to introduce cooling air into the gap between the back plate 142 and the perforated plates 141 and 141' in order to improve the cooling of the perforated plates 141 and 141'.

As the distances of the clearance between the back plate 142 and the perforated plates 141 and 141' respectively are large as explained above, it is easy to carry out the tuning. As a result of experiment, it has been confirmed that it is possible to obtain an optimum effect when the diameter of each opening 143 is 5 mm or less, and also when a distance L1 between the openings 143 in a longitudinal direction and a distance L2 between the openings 143 in a circumferential direction are set to have a relationship of $0.25 \leqq L1/L2 \leqq 4$.

Figure 13A:
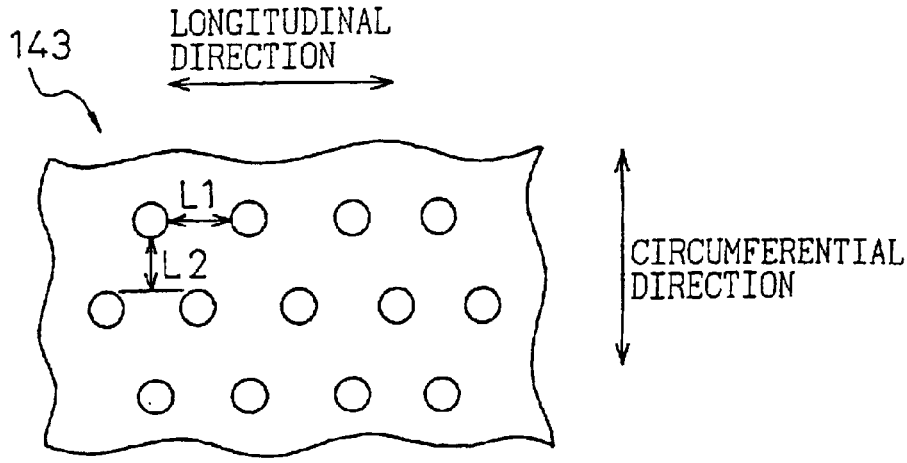
FIG. 13A is a diagram showing a layout of openings formed on a perforated plate in the third modification of the third embodiment. The positions of openings adjacently arrayed in a row of a circumferential direction are differentiated so that the positions of the openings in every other row are aligned in a longitudinal direction.

FIG. 13A shows a layout of openings 143 that are formed on the perforated plate 141. The positions of openings adjacently arrayed in a row of a circumferential direction are differentiated so that the positions of the openings in every other row are aligned in a longitudinal direction.

Figure 13B:
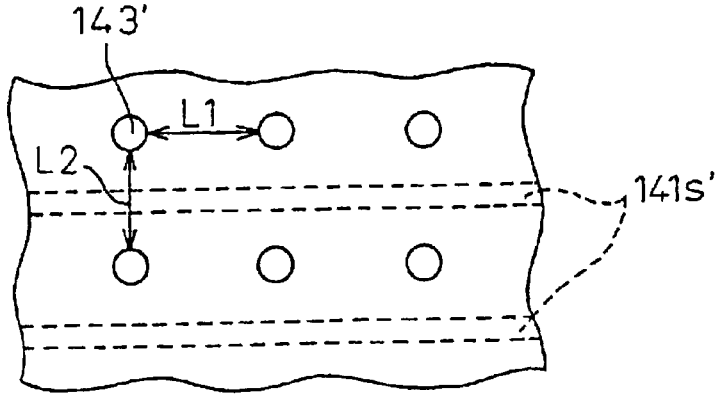
FIG. 13B is a diagram showing a layout of openings formed on a perforated plate in the third modification of the third embodiment. The positions of openings adjacently arrayed in a row of a circumferential direction are the same for each row.

On the other hand, FIG. 13B is a diagram showing a layout of openings 143' that are formed on the perforated plate 141'. As the perforated plate 141' has pipes 141s' for vapor cooling inside the perforated plate, the positions of the openings adjacently arrayed in a row of a circumferential direction are the same for each row.

It is also possible to arrange the layout of the openings 141' as shown in FIG. 13A and to arrange the layout of the openings 141 as shown in FIG. 13B. Further, it is also possible to standardize the layout of the openings of both perforated plates based on one of these layouts.

Figure 14:
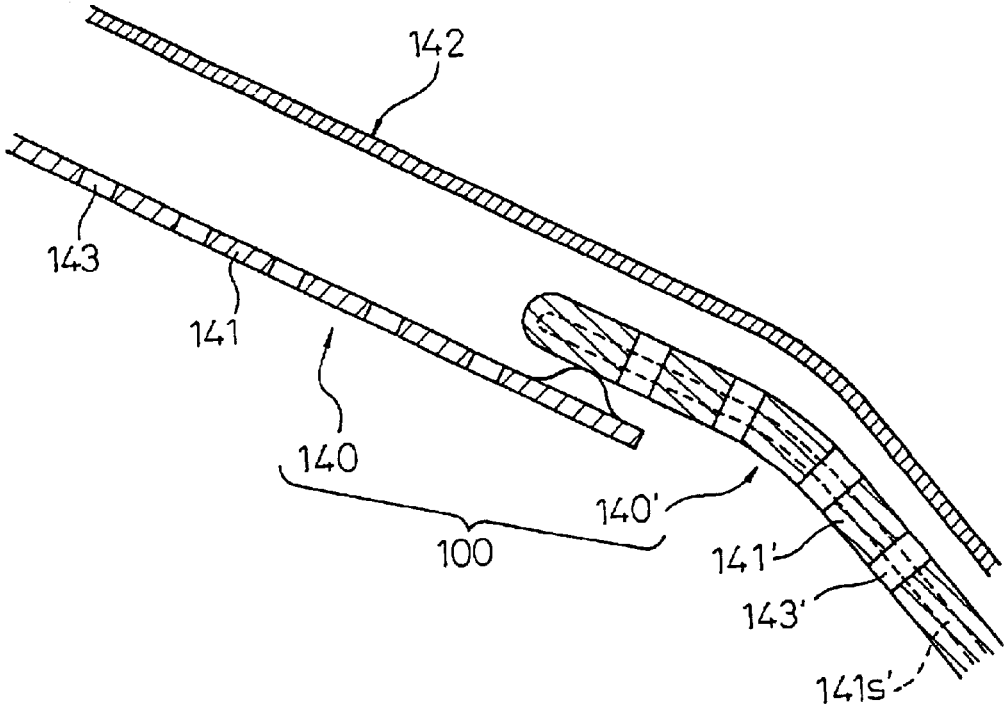
FIG. 14 is a cross-sectional diagram showing a structure of a fourth modification of the third embodiment.

FIG. 14 shows a fourth modification of the third embodiment. This fourth modification is different from the third modification in that openings are not formed on a back plate 142. In this case, the back plate 142 has the same function as that of the cover 50 that forms the convection cooling path 60 in the modification of the first embodiment, the first modification of the second embodiment, and the first modification of the third embodiment respectively. In other words, there is formed a sound absorbing wall tuned by the thickness of the air layer that is formed between the perforated plate 141 and 141' and the back plate 142. Therefore, this work effect is added to the resistance effect of the openings 143 and 143' on the perforated plates 141 and 141' respectively.

Figure 15:
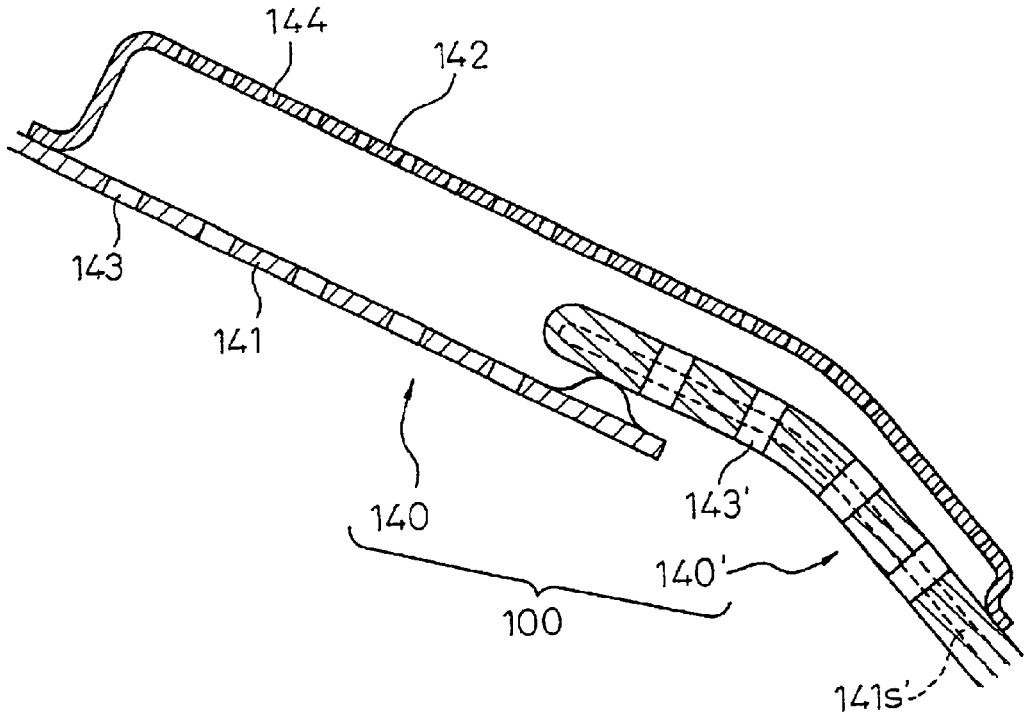
FIG. 15 is a cross-sectional diagram showing a structure of a fifth modification of the third embodiment.
Figure 16A:
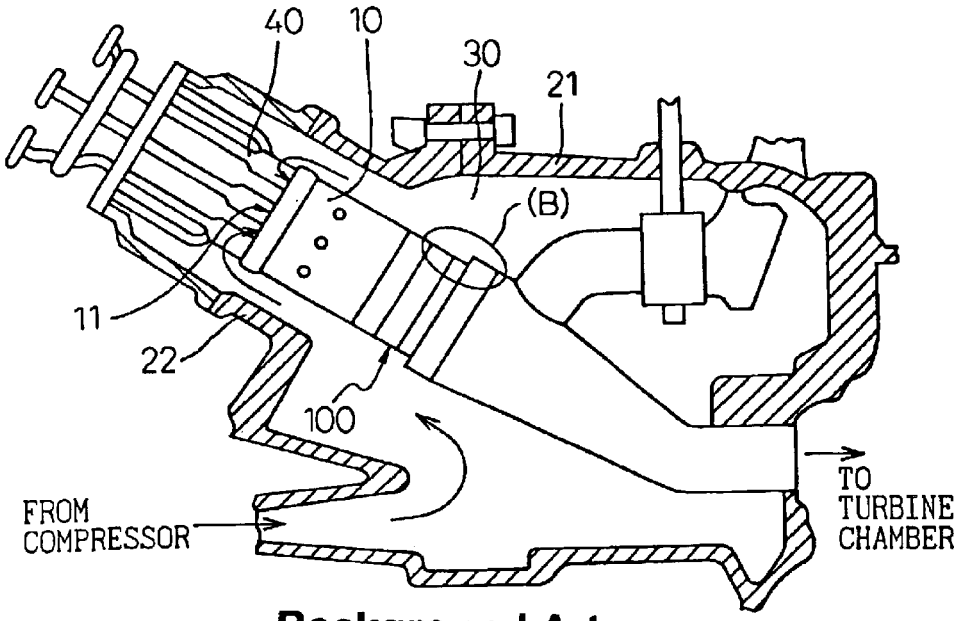
FIG. 16A is a cross-sectional diagram showing a structure of a combustor cut along a plane parallel with an axis, according to a conventional technique.
Figure 16B:
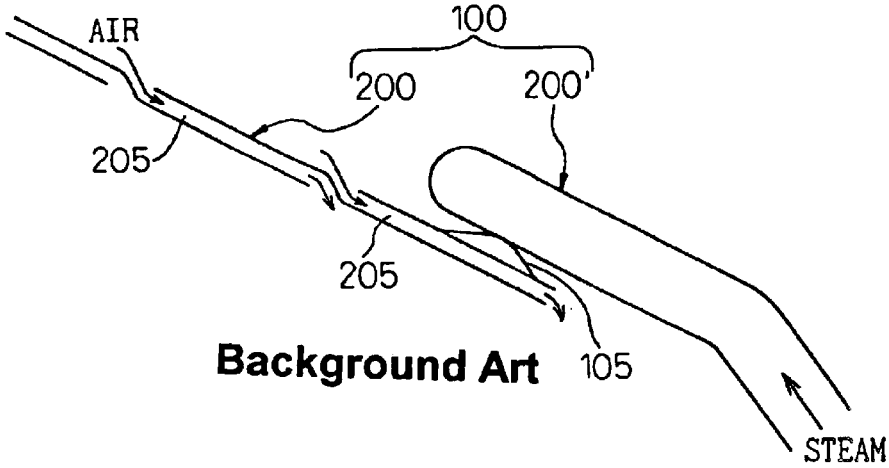
Background Art Fig.16B
FIG. 16B is an enlarged diagram of a portion (B) of FIG. 16A.
Figure 17A:
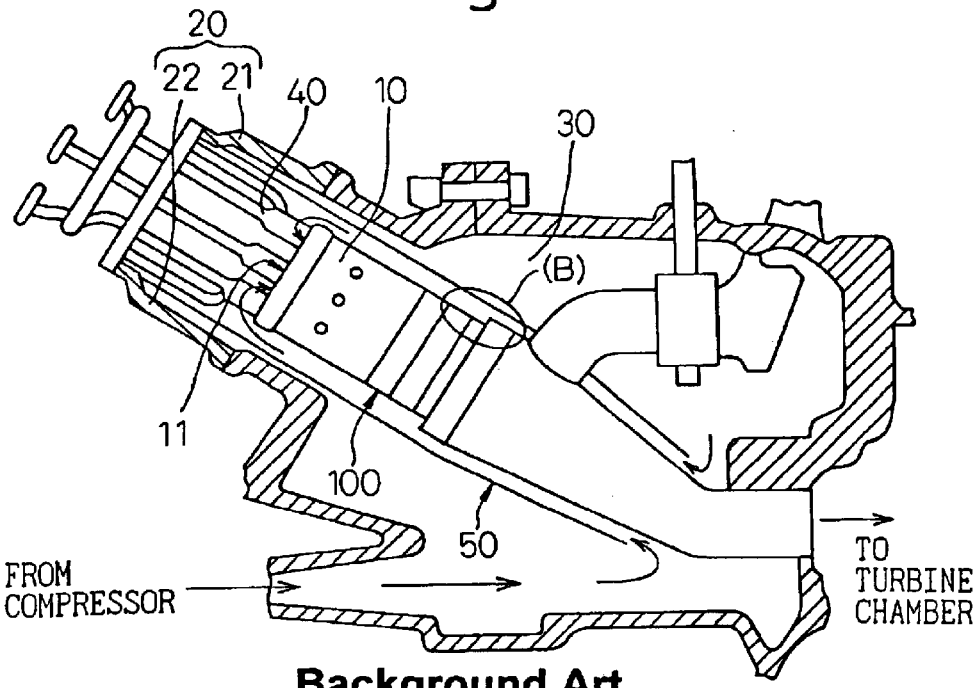
FIG. 17A is a cross-sectional diagram showing a structure of a combustor having a convection cooling layer cut along a plane parallel with an axis, according to another conventional technique.
Figure 17B:
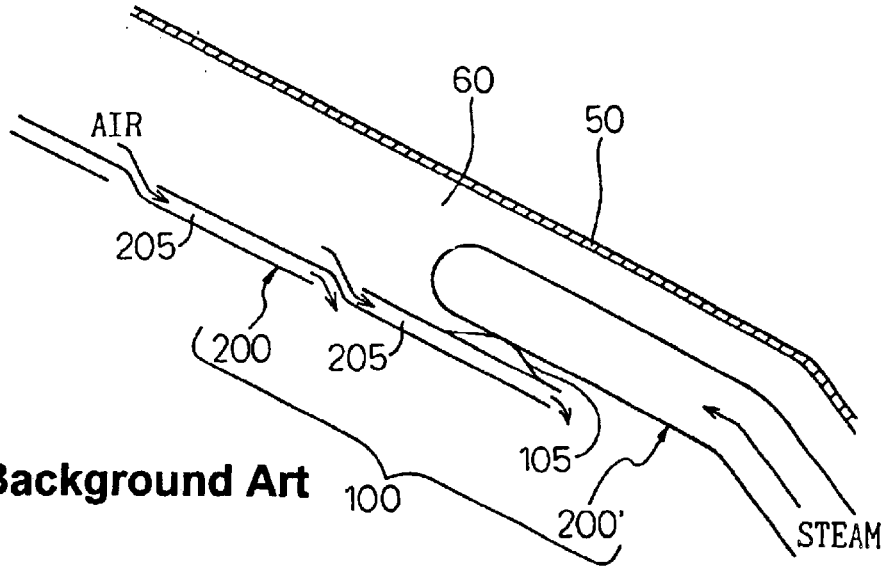
Background Art Fig.17B
FIG. 17B is an enlarged diagram of a portion (B) of FIG. 17A.

FIG. 15 is a diagram showing a fifth modification of the third embodiment. This fifth modification is different from the third modification in that the range of a sound absorbing structure is smaller than that of the third modification. In other words, in the third modification, a sound absorbing structure is formed over the whole length of the combustor 10. On the other hand, in the fifth modification, only a range of an elliptical portion indicated with a sign (B) in FIG. 16A and FIG. 17A is a sound absorbing structure. It is possible to lower the cost by limiting the portion of the sound absorbing structure. A portion having a sound absorbing structure is determined based on a portion of the occurrence of combustion oscillation. Therefore, this portion having a sound absorbing structure is not limited to the portion shown in FIG. 15. It is possible to have a sound absorbing structure in the portion near the fuel nozzle 40 or the portion near the turbine, depending on the characteristics of each combustor.

It is also possible to limit the range of this sound absorbing structure in the first and second embodiments including their modifications, and in the first, second and fourth modifications of the third embodiment respectively.

As explained above, according to the present invention, there is provided a gas turbine combustor in which a part or whole of the wall of the combustor disposed within an intake chamber is formed with an acoustic energy absorbing member that can absorb the acoustic energy of a combustion variation generated within the combustor. Further, the acoustic energy of a combustion variation generated within the combustor is absorbed in the wall of the combustor. Therefore, it is possible to prevent an occurrence of a combustion oscillation phenomenon.

While the invention has been described by reference to specific embodiments chosen for purpose of illustrations, it should be apparent that numerous modifications could be made thereto by those skilled in the art without departing from the basic concept and scope of the invention.

What is claimed is:

1. A gas turbine combustor comprising a combustor wall configured to absorb acoustic energy of a combustion variation, the combustor wall including a first perforated plate, a second perforated plate, and a back plate, the back plate being disposed outside the first perforated plate and the second perforated plate in a radial direction and spaced apart from the first perforated plate and the second perforated plate by a gap, wherein the second perforated plate has cooling pipes embedded therein that are configured to receive cooling fluid, and wherein the first perforated plate has openings which are positioned such that a distance L1 between the openings in a longitudinal direction and a distance L2 between the openings in a circumferential direction have a relationship of $0.25 \leqq L1/L2 \leqq 4$ and positions of the openings adjacently arrayed in a row in the circumferential direction are offset such that the positions of the openings in every other row are aligned in the longitudinal direction.

2. The gas turbine combustor according to claim 1, wherein the distance between the second perforated plate and the back plate is not uniform.

3. The gas turbine combustor according to claim 1, wherein the second perforated plate is cooled with vapor.

4. The gas turbine combustor according to claim 1, wherein the gap is configured to introduce cooling air between the first and second perforated plates and the back plate.

5. The gas turbine combustor according to claim 1, wherein the back plate has openings through which air can pass.

6. The gas turbine combustor according to claim 1, wherein the diameter of holes in the first perforated plate is 5 mm or less.

7. A gas turbine combustor comprising a combustor wall configured to absorb acoustic energy of a combustion variation, the combustor wall including a first perforated plate, a second perforated plate, and a back plate, wherein a portion of the first perforated plate overlaps a portion of the second perforated plate, wherein the back plate is disposed outside the first perforated plate and the second perforated plate in a radial direction and spaced apart from the first perforated plate and the second perforated plate by a gap, and wherein the second perforated plate has cooling pipes embedded therein that are configured to receive cooling fluid.

8. The gas turbine combustor according to claim 7, wherein the back plate has openings extending through the back plate.

9. The gas turbine combustor according to claim 7, wherein perforations in the first perforated plate are provided in a first pattern, wherein perforations in the second perforated plate are provided in a second pattern, and wherein the first pattern is different from the second pattern.

10. The gas turbine combustor according to claim 7, wherein the first perforated plate is connected to the second perforated plate by a spring clip.

11. The gas turbine combustor according to claim 7, wherein the first perforated plate has openings which are positioned such that a distance L1 between the openings in a longitudinal direction and a distance L2 between the openings in a circumferential direction have a relationship of $0.25 \leqq L1/L2 \leqq 4$.

* * * * *